US009805900B1

(12) United States Patent
Findley

(10) Patent No.: US 9,805,900 B1
(45) Date of Patent: Oct. 31, 2017

(54) TWO-DIMENSIONAL GRAPHENE COLD CATHODE, ANODE, AND GRID

(71) Applicant: Lockheed Martin Corporation, Bethesda, MD (US)

(72) Inventor: David Glen Findley, Fort Worth, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 15/145,955

(22) Filed: May 4, 2016

(51) Int. Cl.

| | |
|---|---|
| ***H01J 1/316*** | (2006.01) |
| ***H01J 1/304*** | (2006.01) |
| ***H01J 9/02*** | (2006.01) |
| ***B05D 1/00*** | (2006.01) |

(52) U.S. Cl.
CPC ..... *H01J 1/3042* (2013.01); *B05D 1/005* (2013.01); *H01J 9/025* (2013.01); *B05D 2203/30* (2013.01); *H01J 2201/30469* (2013.01)

(58) Field of Classification Search
CPC ..... H01J 9/025; H01J 1/3042; H01J 1/316
USPC ..... 445/24
See application file for complete search history.

(56) References Cited

U.S. PATENT DOCUMENTS

| | | | | |
|---|---|---|---|---|
| 5,289,086 | A * | 2/1994 | Kane | H01J 3/022 313/308 |
| 5,973,444 | A | 10/1999 | Xu et al. | |
| 6,097,138 | A | 8/2000 | Nakamoto | |
| 6,440,763 | B1 | 8/2002 | Hsu | |
| 6,577,045 | B1 | 6/2003 | Blyablin et al. | |
| 7,160,169 | B2 | 1/2007 | Park | |
| 7,264,978 | B2 | 9/2007 | Ito | |

(Continued)

FOREIGN PATENT DOCUMENTS

| | | |
|---|---|---|
| CN | 102103953 | 6/2011 |
| CN | 102339712 | 2/2012 |

(Continued)

OTHER PUBLICATIONS

Vladimir A. Fonoberov et al., "Giant Enhancement of the Carrier Mobility in Silicon Nanowires with Diamond Coating," Nano Letters 2006, vol. 6, No. 11, 2442-2446, Copyright 2006 American Chemical Society, Published on Web Oct. 19, 2006.

(Continued)

*Primary Examiner* — Joseph L Williams
*Assistant Examiner* — Christopher Raabe
(74) *Attorney, Agent, or Firm* — Baker Botts L.L.P.

(57) ABSTRACT

In an embodiment, a method includes forming a first diamond layer on a substrate and inducing a layer of graphene from the first diamond layer by heating the substrate and the first diamond layer. The method includes forming a second diamond layer on top of the layer of graphene and applying a mask to the second diamond layer. The mask includes a shape of a cathode, an anode, and one or more grids. The method further includes forming a two-dimensional cold cathode, a two-dimensional anode, and one or more two-dimensional grids by reactive-ion electron-beam etching. Each of the two-dimensional cold cathode, the two-dimensional anode, and the one or more two-dimensional grids includes a portion of the first diamond layer, the graphene layer, and the second diamond layer such that the graphene layer is positioned between the first diamond layer and the second diamond layer.

15 Claims, 4 Drawing Sheets

(56) References Cited

U.S. PATENT DOCUMENTS

| | | | | |
|---|---|---|---|---|
| 8,692,226 | B2 | 4/2014 | Cheatham, III et al. | |
| 8,802,514 | B2 | 8/2014 | Haensch et al. | |
| 8,809,153 | B2 | 8/2014 | Afzali-Ardakani et al. | |
| 8,834,967 | B2 | 9/2014 | Afzali-Ardakani et al. | |
| 2002/0160111 | A1 | 10/2002 | Sun et al. | |
| 2006/0214561 | A1* | 9/2006 | Nomura | H01J 1/304 313/498 |
| 2013/0169142 | A1 | 7/2013 | Hyde et al. | |
| 2014/0255701 | A1* | 9/2014 | Lee | H01B 1/04 428/408 |
| 2015/0060757 | A1 | 3/2015 | Lee et al. | |
| 2016/0343547 | A1* | 11/2016 | Lim | H01J 37/32642 |

FOREIGN PATENT DOCUMENTS

| | | |
|---|---|---|
| CN | 103848415 | 6/2014 |
| KR | 101438733 | 9/2014 |

OTHER PUBLICATIONS

Jin-Woo Han et al., "Vacuum nanoelectronics: Back to the future?—Gate Insulated nanoscale vacuum channel transistor," Applied Physics Letters 100, May 5, 2013 (2012), Copyright 2012 American Institute of Physics, published online May 23, 2012.

Vanderbilt engineers design diamond circuits for extreme environments, Vanderbilt University School of Engineering, article dated Aug. 4, 2011; http://engineering.vanderbilt.edu/news/2011/vanderbilt-engineers-design-diamond-circuits-f . . . ; printed from the Internet May 3, 2016.

Anurat Wisitsorat-at, "Micropatterned Diamond Vacuum Field Emission Devices," Dissertation Submitted to the Faculty of the Graduate School of Vanderbilt University (Part 1), May 2002.

Anurat Wisitsorat-at, "Micropatterned Diamond Vacuum Field Emission Devices," Dissertation Submitted to the Faculty of the Graduate School of Vanderbilt University (Part 2), May 2002.

* cited by examiner

TWO-DIMENSIONAL GRAPHENE COLD CATHODE, ANODE, AND GRID

TECHNICAL FIELD

The present disclosure relates in general to electronics, and more particularly to a two-dimensional graphene cold cathode, anode, and grid.

BACKGROUND

A processor may be used in many applications where the processing components are subject to intense heat and radiation. For example, a missile may carry a processor that operates at high temperatures, or a satellite may carry a processor that operates in a high radiation environment (e.g., solar protons or cosmic rays). However, heat and radiation may degrade or damage these processing components. Processors based on semiconducting materials, such as silicon, silicon-germanium, gallium arsenide, or gallium nitride, are particularly vulnerable to high heat and radiation. Consequently, these processors require heavy shielding and expensive cooling systems. Vacuum microelectronic devices are immune to these pernicious operating conditions and are thus more suitable for such operating environments. However, vacuum microelectronics have suffered from relatively high operating voltages and eventual failure due to cold cathode tip erosion.

SUMMARY

According to one embodiment, a method includes forming a first diamond layer on a substrate and inducing a layer of graphene from the first diamond layer by heating the substrate and the first diamond layer. A second diamond layer may be formed on top of the layer of graphene and a mask may be applied to the diamond layer. The mask may include a shape of a cathode, an anode, and one or more grids. A two-dimensional cold cathode, a two-dimensional anode, and one or more two-dimensional grids may be formed by reactive-ion electron-beam etching. Each of the two-dimensional cold cathode, the two-dimensional anode, and the one or more two-dimensional grids may include a portion of the first diamond layer, the graphene layer, and the second diamond layer such that the graphene layer is positioned between the first diamond layer and the second diamond layer.

Technical advantages of certain embodiments may include extending the life of a cathode by preventing the erosion of the tip of a cathode. Another advantage may include lowering the operating voltage of a microelectronic and simplifying microelectronic design via phonon confinement. Other technical advantages will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the disclosed embodiments and their features and advantages, reference is now made to the following description, taken in conjunction with the accompanying drawings, in which.

DETAILED DESCRIPTION

Processors may include electrodes, which are components through which electrons may enter or leave. One type of electrode is a cold cathode (e.g., a Spindt-type cathode). A cold cathode may emit electrons when subject to certain voltages. For example, a missile may have cathodes in its processor that are subject to intense heat and radiation as the missile travels to its target. Certain cathodes may have pointed tips that may deform or erode as the cathode emits electrons due to atomic spallation. The tips of these cathodes may become blunt and cause the processor to stop functioning.

To overcome these and other problems, a two-dimensional cold cathode may be formed using a layer of graphene positioned between two diamond layers in an embodiment. By positioning the layer of graphene between the two diamond layers, atoms in the cathode may be confined and remain in place such that tip erosion decreases or is eliminated altogether. Alternative embodiments may position the layer of graphene between other materials, such as silicon carbide, as explained below.

Accordingly, aspects of the present disclosure include a method that, in one embodiment, forms a first diamond layer on a substrate and induces a layer of graphene from the first diamond layer by heating the substrate and the first diamond layer. A second diamond layer may be formed on top of the layer of graphene and a mask may be applied to the diamond layer. The mask may include a shape of a cathode, an anode, and one or more grids. A two-dimensional cold cathode, a two-dimensional anode, and one or more two-dimensional grids may be formed by reactive-ion electron-beam etching. Each of the two-dimensional cold cathode, the two-dimensional anode, and the one or more two-dimensional grids may include a portion of the first diamond layer, the graphene layer, and the second diamond layer such that the graphene layer is positioned between the first diamond layer and the second diamond layer.

The present disclosure may provide numerous advantages. For example, a two-dimensional cold cathode with a layer of graphene confined by diamond or silicon carbide may decrease tip erosion by keeping graphene carbon atoms in place. As a result of the decreased tip erosion, the life of a cathode may be extended. As another example, a two-dimensional cold cathode with a layer of graphene confined by diamond or silicon carbide may lower the operating voltage of a microelectronic through phonon confinement. As yet another example, a two-dimensional cold cathode with a layer of graphene confined by diamond or silicon carbide may simplify microelectronic design because the vacuum microelectronic device may operate at a lower voltage. Operating at a lower voltage may allow for reduced cooling requirements, thereby reducing shielding and cooling costs, and weight.

Figure 1:
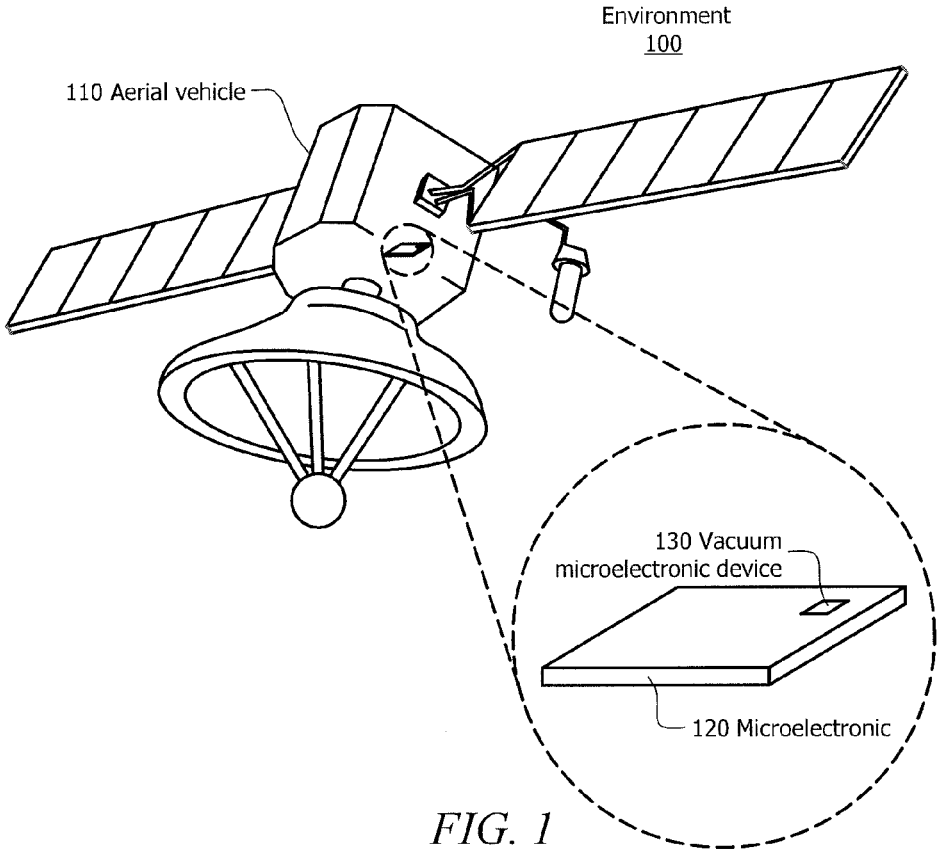
FIG. 1 is a diagram illustrating an example environment in which an example microelectronic may be used, according to certain embodiments of the present disclosure.
Figure 2A:
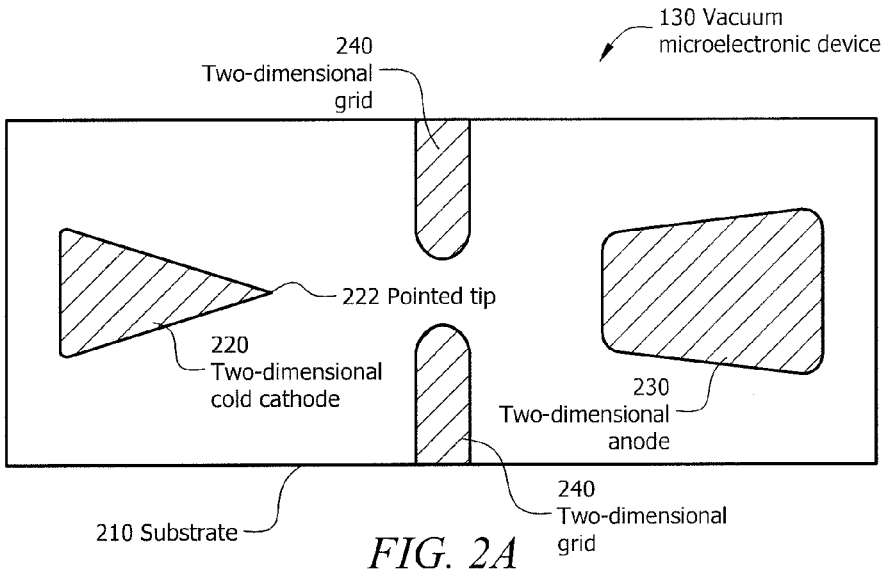
FIG. 2A is a top view illustrating an example vacuum microelectronic device that may be used in the microelectronic of FIG. 1, according to certain embodiments of the present disclosure.
Figure 2B:
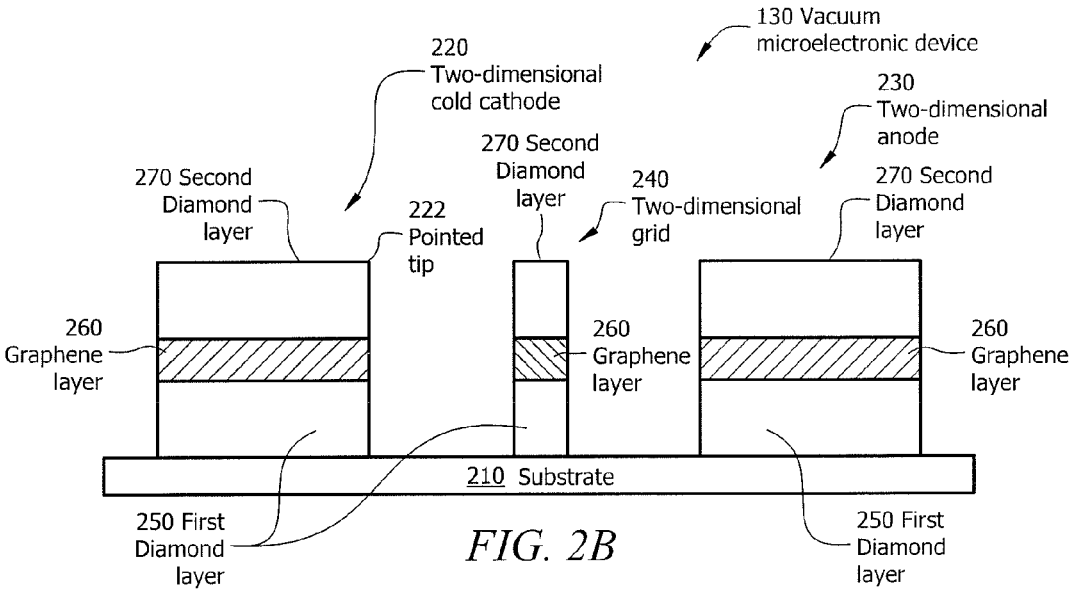
FIG. 2B is a side view illustrating the vacuum microelectronic device of FIG. 2A, according to certain embodiments of the present disclosure.
Figure 2C:
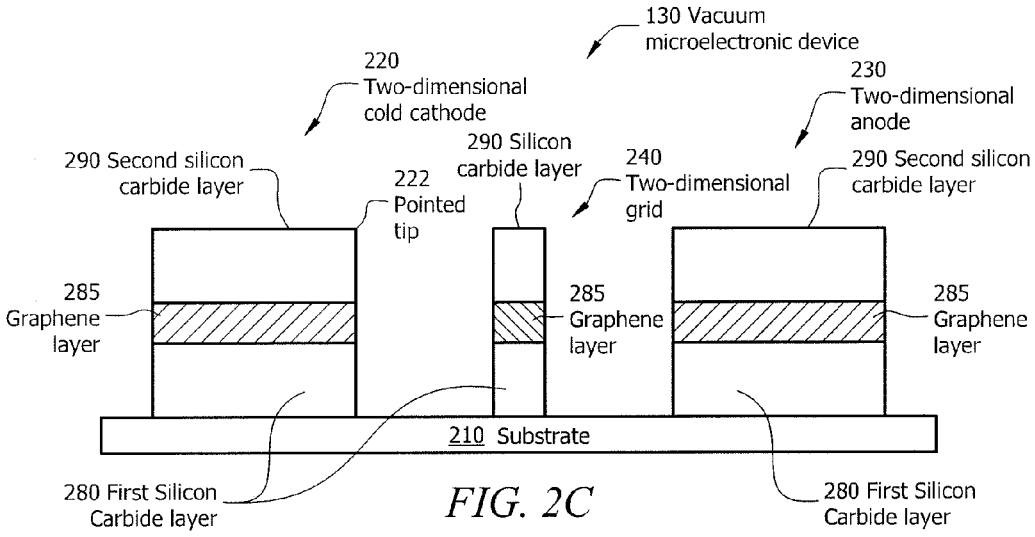
FIG. 2C is a side view illustrating the vacuum microelectronic device of FIG. 2A, according to certain embodiments of the present disclosure.
Figure 3:
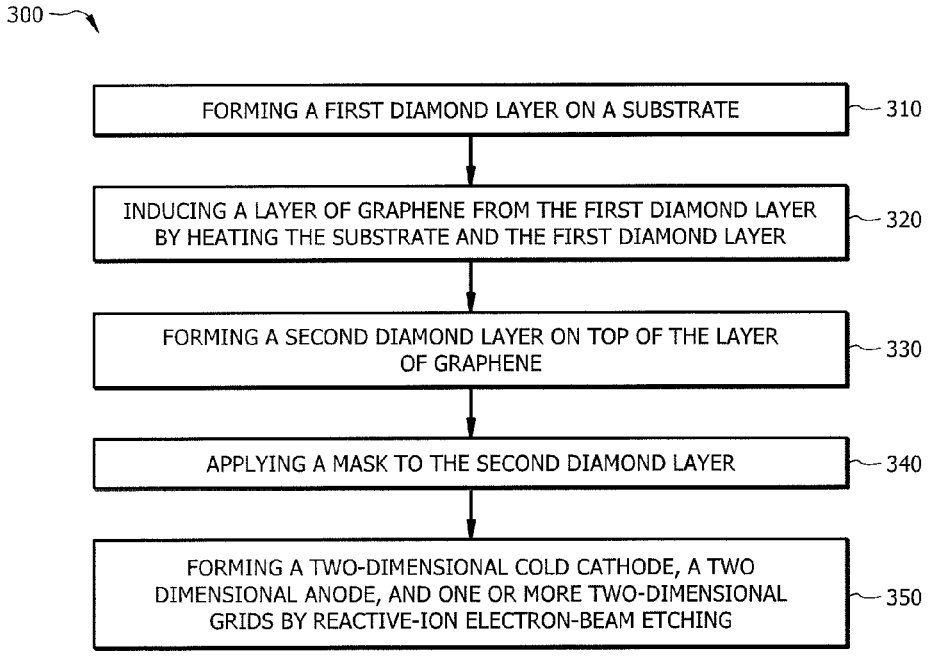
FIG. 3 is a flow chart illustrating an example method of forming a vacuum microelectronic device, according to certain embodiments of the present disclosure.
Figure 4:
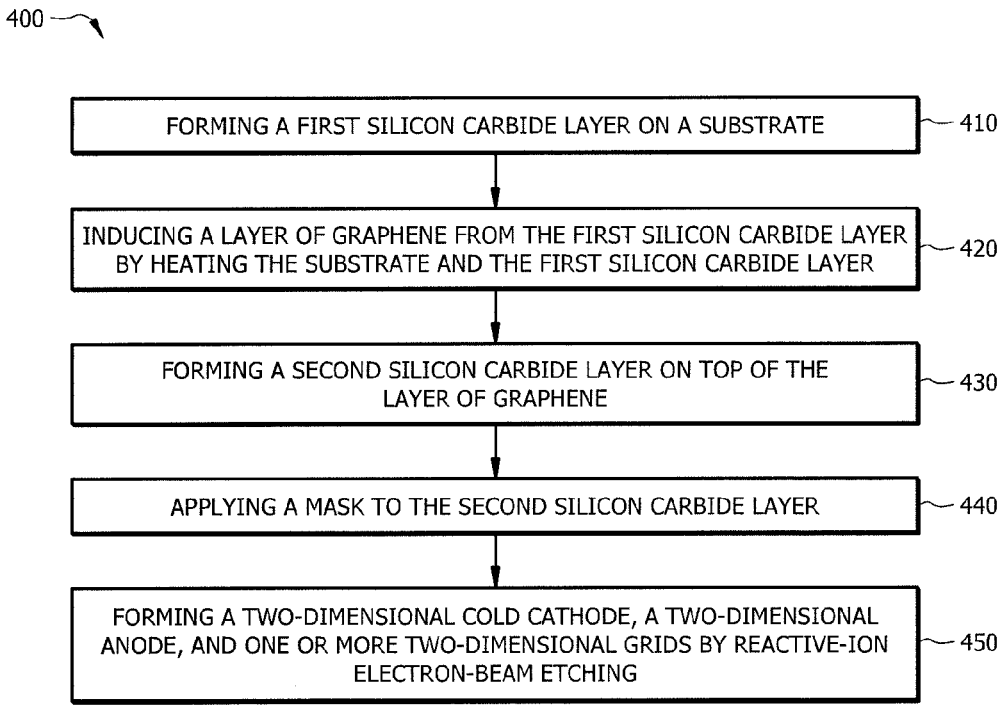
FIG. 4 is a flow chart illustrating an example method of forming a vacuum microelectronic device, according to certain embodiments of the present disclosure.

Additional details are discussed in reference to FIGS. 1 through 4. FIG. 1 illustrates an example environment 100 in which an example microelectronic 120 may be used. FIGS. 2A, 2B, and 2C show various views of an example vacuum microelectronic device 130 that may be used in microelectronic 120 of FIG. 1. FIGS. 3 and 4 show example methods of forming vacuum microelectronic device 130.

FIG. 1 is a diagram illustrating an example environment 100 in which an example microelectronic 120 may be used, according to certain embodiments of the present disclosure. Environment 100 may be any environment in which microelectronic 120 may be used. For example, environment 100 may include a communications satellite in space. As another example, environment 100 may include a missile in the air. Although environment 100 is illustrated as an airborne environment, environment 100 may include land-based environments, such as a boat operating on water or a motor vehicle operating on land. Environment 100 may subject microelectronic 120 to high temperatures and high radiation. Two-dimensional cold cathode 220 (described below) may prevent these high temperatures and radiation from deforming the tip of two-dimensional cold cathode 220 and thus prevent interference with electronic operation (e.g., inducing soft and hard errors and failures). Environment 100 may include an aerial vehicle 110, a microelectronic 120, and vacuum microelectronic device 130 in certain embodiments.

Aerial vehicle 110 may be any type of airborne vehicle configured in certain embodiments. For example, aerial vehicle 110 may be an airplane, a space shuttle, a satellite, a missile, or any other type of airborne vehicle. Although illustrated as aerial vehicle 110, environment 100 may include land-based vehicles (e.g., a boat or a motor vehicle or ground robot or structures (e.g., a radiation intense computing environment). Aerial vehicle 110 may include microelectronic 120 and vacuum microelectronic device 130 in certain embodiments.

Microelectronic 120 may be an electronic device of a very small scale in an embodiment. For example, microelectronic 120 may be micrometer scale or smaller. Microelectronic 120 may be a processing device in certain embodiments. Microelectronic 120 may include vacuum microelectronic device 130 in certain embodiments.

Vacuum microelectronic device 130 may be a device that controls electric current between electrodes in an evacuated container in an embodiment. For example, vacuum microelectronic device 130 may be a diode, a triode, a tetrode, a pentode, or any other type of electrode. As described more fully below, certain components of vacuum microelectronic device 130, such as two-dimensional cold cathode 220, may have a layer of graphene between layers of diamond or silicon carbide.

FIG. 2A is a top view illustrating an example vacuum tube 130 that may be used in microelectronic 120 of FIG. 1, according to certain embodiments of the present disclosure. Vacuum microelectronic device 130 may include a substrate 210, a two-dimensional cold cathode 220, a two-dimensional anode 230, and one or more two-dimension grids 240 in certain embodiments.

Substrate 210 may be one or more layers of material on which two-dimensional cold cathode 220, two-dimensional anode 230, and two-dimensional grids 240 are supported in an embodiment. Substrate 210 may be made of any type of material in certain embodiments. For example, substrate 210 may be made of silicon, silicon carbide, sapphire, diamond, tungsten, hafnium, or any other type of material. Substrate 210 may be made in any shape. For example, substrate 210 may be rectangular. As another example, substrate 210 may be circular. Substrate 210 may be coated with one or more layers of material in certain embodiments. For example, substrate 210 may be coated with a poly(hydridocarbyne) layer. As another example, substrate 210 may be coated with a poly(silyne-co-hydridocarbyne) layer. As another example, substrate 210 may be coated with a poly(methylsilyne) layer. Substrate 210 may be coated using any type of coating method. In some embodiments, substrate 210 may be coated with a graphene-inducing catalyst, such as iron or rhenium. For example, substrate 210 may be coated using a spin coating process. In that example, material may be deposited near the center of substrate 210 and substrate 210 may be rotated at high speeds such that the material evenly spreads out due to centrifugal force.

Two-dimensional cold cathode 220 may be an electrode from which electrons are emitted in certain embodiments. Two-dimensional cold cathode 220 may have a pointed tip 222 (e.g., to enhance cold electron emission) and two rounded edges (e.g., to suppress electron emission) in certain embodiments. Two-dimensional cold cathode 220 may be opposed to two-dimensional anode 230 in certain embodiments. Electrons flowing out of two-dimensional cold cathode 220 may flow to two-dimensional anode 230 through two-dimensional grids 240 in an embodiment. Two-dimensional cold cathode 220 may be supported by substrate 210 in an embodiment. Two-dimensional cold cathode 220 may be formed according to the methods described in FIGS. 3 and 4 such that two-dimensional cold cathode 220 may have a layer of graphene positioned between diamond and/or silicon carbide layers in certain embodiments. As a result of positioning graphene between diamond and/or silicon carbide layers, pointed tip 222 of two-dimensional cold cathode 220 may not erode because graphene carbon atoms are held in place thereby extending the life of microelectronic 120.

Two-dimensional anode 230 may be an electrode that collects the electrons emitted from two-dimensional cold cathode 220 in certain embodiments. Two-dimensional anode 230 may be positioned opposite to two-dimensional cold cathode 220 in an embodiment. Two-dimensional anode 230 may have rounded edges in an embodiment. Two-dimensional anode 230 may be supported by substrate 210 in an embodiment. Two-dimensional anode 230 may be formed according to the methods described in FIGS. 3 and 4 below such that two-dimensional anode 230 may have a layer of graphene positioned between diamond and/or silicon carbide layers for phonon confinement in an embodiment.

Two-dimensional grids 240 may be any component configured to control the flow of electrons from two-dimensional cold cathode 220 to two-dimensional anode 230 in certain embodiments. Two-dimensional grids 240 may be any shape in an embodiment. Two-dimensional grids 240 may have rounded edges in an embodiment. Two-dimensional grids 240 may be positioned between two-dimensional cold cathode 220 and two-dimensional anode 230 in embodiments. Two-dimensional grids 240 may be opposed to other grids with a space separating the opposing two-dimensional grids 240 in an embodiment. Any number of two-dimensional grids 240 may be used. For example, vacuum microelectronic device 130 may include two two-dimensional grids 240 to create a tetrode. As another example, vacuum tube 130 may include three two-dimensional grids 240 to create a pentode. Two-dimensional grids 240 may be formed according to the methods described in FIGS. 3 and 4 such that two-dimensional grids 240 may have a layer of graphene positioned between diamond and/or silicon carbide layers for phonon confinement in an embodiment.

FIG. 2B is a side view illustrating vacuum tube 130 of FIG. 2A, according to certain embodiments of the present disclosure. As discussed above with respect to FIG. 2A, vacuum tube 130 may include substrate 210, two-dimensional cold cathode 220, two-dimensional anode 230, and two-dimensional grids 240. As shown in the example embodiment of FIG. 2B, each of two-dimensional cold cathode 220, two-dimensional anode 230, and two-dimensional grids 240 may include a first diamond layer 250, a graphene layer 260, and a second diamond layer 270 in certain embodiments.

First diamond layer 250 may be a layer of diamond formed according to the method of FIG. 3 in certain embodiments. For example, first diamond layer 250 may be formed by thermalizing a layer of poly(hydridocarbyne). First diamond layer 250 may facilitate the formation of graphene layer 260 in certain embodiments. For example, first diamond layer 250 may be heated to form graphene layer 260. First diamond layer 250 may also confine graphene layer 260. For example, first diamond layer 250 may prevent carbon atoms from escaping graphene layer 260. First diamond layer 250 may be positioned directly on top of substrate 210 and below graphene layer 260 in certain embodiments. For example, first diamond layer 250 may be formed on top of substrate 210 and graphene layer 260 may be formed or deposited on top of first diamond layer 250. First diamond layer 250 may be a hexagonal diamond in certain embodiments.

Graphene layer 260 may be a sheet of carbon atoms such that the sheet is one atom thick in an embodiment. In certain embodiments, multiple graphene layers 260 may be used. Graphene layer 260 may be formed according to the method of FIG. 3 in an embodiment. For example, graphene layer 260 may be induced from first diamond layer 250 by baking first diamond layer 250 in an embodiment. Graphene layer 260 may be positioned on top of first diamond layer 250 and below second diamond layer 270 in certain embodiments. By confining graphene layer 260 between first diamond layer 250 and second diamond layer 270, carbon atoms of graphene layer 260 cannot escape and pointed tip 222 of two-dimensional cold cathode 220 may not erode. Two-dimensional cold cathode 220 may therefore have an extended life, which may also extend the life of microelectronic 120.

Second diamond layer 270 may be a layer of diamond formed according to the method of FIG. 3 in an embodiment. Second diamond layer 270 may be formed directly on top of graphene layer 260 in certain embodiments. For example, a poly(hydridocarbyne) layer may be spin coated on graphene layer 260, and second diamond layer 270 may be formed by thermalizing the poly(hydridocarbyne) layer. Second diamond layer 270 may confine graphene layer 260, thereby preventing carbon atoms from escaping in an embodiment. Second diamond layer 270 may be a hexagonal diamond in certain embodiments.

FIG. 2C is a side view illustrating vacuum microelectronic device 130 of FIG. 2A, according to certain embodiments of the present disclosure. As discussed above with respect to FIG. 2A, vacuum microelectronic device 130 may include substrate 210, two-dimensional cold cathode 220, two-dimensional anode 230, and two-dimensional grids 240. As shown in the example embodiment of FIG. 2C, each of two-dimensional cold cathode 220, two-dimensional anode 230, and two-dimensional grids 240 may include substrate 210, a first silicon carbide layer 280, a graphene layer 285, and a second silicon carbide layer 290 in certain embodiments.

First silicon carbide layer 280 may be a layer of silicon carbide formed according to the method of FIG. 4 in certain embodiments. For example, first silicon carbide layer 280 may be formed from a layer of poly(methylsilyne) or poly(silyne-co-hydridocarbyne). In that example, the layer of poly(methylsilyne) or poly(silyne-co-hydridocarbyne) may be deposited on substrate 210, such as by spin coating substrate 210, and the layer of poly(methylsilyne) or poly (silyne-co-hydridocarbyne) may be thermalized to form first silicon carbide layer 280. First silicon carbide layer 280 may facilitate the confinement and formation of graphene layer 285. For example, first silicon carbide layer 280 may hold carbon atoms of graphene layer 285 in place thereby preventing pointed tip 222 of two-dimensional cold cathode 220 from eroding. First silicon carbide layer 280 may be positioned directly on top of substrate 210 and below graphene layer 285 in certain embodiments. For example, first silicon carbide layer 280 may be formed on top of substrate 210 and graphene layer 285 may be formed or deposited on top of first silicon carbide layer 280.

Graphene layer 285 may be a sheet of carbon atoms such that the sheet is one atom thick in an embodiment. Graphene layer 285 may be formed according to the method of FIG. 4 in an embodiment. For example, graphene layer 285 may be induced from first silicon carbide layer 280 by baking first silicon carbide layer 280 in an embodiment. In that example, graphene layer 285 may be formed via thermal decomposition of silicon carbide layer 280. Graphene layer 285 may be positioned on top of first silicon carbide layer 280 and below second silicon carbide layer 290 in certain embodiments. Based on that positioning, graphene layer 285 may be confined by first silicon carbide layer 280 and second silicon carbide layer 290. By confining graphene layer 285 in that manner, carbon atoms of graphene layer 285 cannot escape and pointed tip 222 of two-dimensional cold cathode 220 may not erode. Two-dimensional cold cathode 220 may therefore have an extended life, which may also extend the life of microelectronic 120.

Second silicon carbide layer 290 may be a layer of silicon carbide formed according to the method of FIG. 4 in an embodiment. For example, second silicon carbide layer 290 may be formed from a layer of poly(methylsilyne) or poly(silyne-co-hydridocarbyne). In that example, the layer of poly(methylsilyne) or poly(silyne-co-hydridocarbyne) may be deposited on graphene layer 285, such as by spin coating graphene layer 285, and the layer of poly(methylsilyne) or poly(silyne-co-hydridocarbyne) may be thermalized to form second silicon carbide layer 290. Second silicon carbide layer 290 may be positioned directly on top of graphene layer 285 in certain embodiments. Second silicon carbide layer 290 may facilitate the confinement of graphene layer 285 by holding carbon atoms of graphene layer 285 in place.

In an alternative embodiment, a layer of diamond may be used instead of second silicon carbide layer 290. In this embodiment, graphene layer 285 may be spin coated with a layer of poly(hydridocarbyne). The layer of poly(hydridocarbyne) may be thermalized to form a layer of diamond on top of graphene layer 285 in certain embodiments. For example, the layer of poly(hydridocarbyne) may be baked at up to 800 degrees Celcius such that the poly(hydridocarbyne) forms diamond. In this embodiment, each of two-dimensional cold cathode 220, two-dimensional anode 230, and two-dimensional grid 240 may have first silicon carbide layer 280, graphene layer 285, and a layer of diamond. Graphene layer 285 may be positioned on top of first silicon carbide layer 280 and below the layer of diamond. As a result, graphene layer 285 may be confined by first silicon carbide layer 280 and the layer of diamond such that the carbon atoms may remain in place and pointed tip 222 of two-dimensional cold cathode 220 may not erode.

FIG. 3 is a flow chart illustrating an example method 300 of forming vacuum microelectronic device 130, according to certain embodiments of the present disclosure. Method 300 starts at step 310, where first diamond layer 250 is formed on substrate 210 in an embodiment. First diamond layer 250 may be formed on substrate 210 by coating substrate 210 with a poly(hydridocarbyne) layer in an embodiment. Substrate 210 may be coated with the poly(hydridocarbyne) layer in any manner. For example, substrate 210 may be spin coated. In that example, the poly(hydridocarbyne) layer may be deposited near the center of substrate 210 and substrate 210 may be rotated at high speeds such that the material evenly spreads out due to centrifugal force. Once substrate 210 is coated with the poly(hydridocarbyne) layer, the poly(hydridocarbyne) layer may be thermalized to form first diamond layer 250. For example, the poly(hydridocarbyne) layer may be baked or heated, such as in an inert atmosphere (e.g., Argon or Nitrogen). In certain embodiments, the poly(hydridocarbyne) layer may be thermalized at various temperatures. For example, the poly(hydridocarbyne) layer may be heated at up to 800 degrees Celcius. As another example, the poly(hydridocarbyne) layer may be heated between 150 and 800 degrees Celcius. In certain embodiments, the poly(hydridocarbyne) layer may be thermalized in an inert atmosphere.

At step 320, graphene layer 260 may be induced from first diamond layer 250 by heating substrate 210 and first diamond layer 250 in an embodiment. For example, substrate 210 and first diamond layer 250 may be heated in a temperature range between 900 and 1900 degrees Celcius. As another example, substrate 210 and first diamond layer 250 may be heated in a temperature range between 400 and 500 degrees Celcius to induce graphene formation. As a result of heating substrate 210 and first diamond layer 250, graphene layer 260 may be formed or grown on top of first diamond layer 250.

At step 330, second diamond layer 270 may be formed on top of graphene layer 260 in an embodiment. Second diamond layer 270 may be formed on graphene layer 260 by first coating graphene layer 260 with a poly(hydridocarbyne) layer in an embodiment. Graphene layer 260 may be coated with the poly(hydridocarbyne) layer in any manner. For example, graphene layer 260 may be spin coated. In that example, the poly(hydridocarbyne) layer may be deposited near the center of graphene layer 260, and graphene layer 260 may be rotated at high speeds such that the material evenly spreads out due to centrifugal force. Once graphene layer 260 is coated with the poly(hydridocarbyne) layer, the poly(hydridocarbyne) layer may be thermalized to form second diamond layer 270 in an embodiment. For example, the poly(hydridocarbyne) layer may be baked or heated in an inert atmosphere. In certain embodiments, the poly(hydridocarbyne) layer may be thermalized at various temperatures to form second diamond layer 270. For example, the poly(hydridocarbyne) layer may be heated at 800 degrees Celcius. As another example, the poly(hydridocarbyne) layer may be heated between 150 and 800 degrees Celcius. In certain embodiments, the poly(hydridocarbyne) layer may be thermalized in an inert atmosphere.

At step 340, a mask may be applied to second diamond layer 270. The mask may include a two-dimensional shape of a cathode, an anode, and one or more grids in certain embodiments. The mask may facilitate the reactive-ion electron-beam etching of the geometries of two-dimensional cold cathode 220, two-dimensional anode 230, and two-dimensional grids 240. For example, as electrons impact the top surface of second diamond layer 270, the reactive ions may remove diamond in unmasked areas and may not remove any diamond in masked areas (e.g., the geometries of two-dimensional cold cathode 220, two-dimensional anode 230, and two-dimensional grids 240).

At step 350, two-dimensional cold cathode 220, two-dimensional anode 230, and one or more two-dimensional grids 240 may be formed by reactive-ion electron-beam etching around the mask of step 340 in an embodiment. For example, reactive-ions may impact a top surface of second diamond layer 270 and remove any material that is unmasked. Because the geometries of two-dimensional cold cathode 220, two-dimensional anode 230, and two-dimensional grids 240 are masked, the electrons may not remove material within the masked geometries of those components, thereby forming two-dimensional cold cathode 220, two-dimensional anode 230, and two-dimensional grids 240 in an embodiment. As a result, each of two-dimensional cold cathode 220, two-dimensional anode 230, and two-dimensional grids 240 may include a portion of first diamond layer 250, graphene layer 260, and second diamond layer 270 such that graphene layer 260 is positioned between first diamond layer 250 and second diamond layer 270. Positioning graphene layer 260 between first diamond layer 250 and second diamond layer 270 may prevent carbon atoms from escaping and eroding pointed tip 222 of two-dimensional cold cathode 220.

As an example embodiment of operation, first diamond layer 250 may be formed on substrate 210, such as by coating substrate 210 with poly(hydridocarbyne) and thermalizing poly(hydridocarbyne). Graphene layer 260 may be induced from first diamond layer 250 by heating first diamond layer 250. Second diamond layer 270 may be formed on top of graphene layer 260, such as by coating graphene layer 260 with poly(hydridocarbyne) and thermalizing poly (hydridocarbyne). A mask may be applied to the top surface of second diamond layer 270 in the geometries of a cathode, an anode, and one or more grids. Two-dimensional cold cathode 220, two-dimensional anode 230, and two-dimensional grids 240 may be formed by electron-beam etching. Each of two-dimensional cold cathode 220, two-dimensional anode 230, and two-dimensional grids 240 may include a portion of first diamond layer 250, graphene layer 260, and second diamond layer 270.

FIG. 4 is a flow chart illustrating an example method 400 of forming vacuum microelectronic device 130, according to certain embodiments of the present disclosure. Method 400 starts at step 410, where first silicon carbide layer 280 may be formed on substrate 210 in an embodiment. First silicon carbide layer 280 may be formed by coating substrate 210 with poly(methylsilyne) or poly(silyne-co-hydridocarbyne) and thermalizing the poly(methylsilyne) or poly(silyne-co-hydridocarbyne) in an embodiment. In that embodiment, the poly(methylsilyne) or poly(silyne-co-hydridocarbyne) may be thermalized at a range of temperatures between 200 and 1500 degrees Celcius. The poly(methylsilyne) or poly(silyne-co-hydridocarbyne) may be thermalized to form first silicon carbide layer 280 in a non-oxygenated atmosphere.

Substrate 210 may be coated with poly(methylsilyne) or poly(silyne-co-hydridocarbyne) in any manner. For example, substrate 210 may be spin coated with poly(methylsilyne) or poly(silyne-co-hydridocarbyne).

At step 420, graphene layer 285 may be induced from first silicon carbide layer 280 by heating substrate 210 and first silicon carbide layer 280 in an embodiment. Substrate 210 and first silicon carbide layer 280 may be heated at a range of temperatures to form graphene layer 285, such as between 1500 and 1700 degrees Celcius. Inducing graphene layer 285 from first silicon carbide layer 280 may result from the thermal decomposition of the top surface of first silicon carbide layer 280 in some embodiments.

At step 430, second silicon carbide layer 290 may be formed on top of graphene layer 285 in an embodiment. Second silicon carbide layer 290 may be formed by coating graphene layer 285 with a layer of poly(methylsilyne) or poly(silyne-co-hydridocarbyne) in certain embodiments. In those embodiments, once graphene layer 285 is coated with the layer of poly(methylsilyne) or poly(silyne-co-hydridocarbyne), the layer of poly(methylsilyne) or poly(silyne-co-hydridocarbyne) may be thermalized to form second silicon carbide layer 290. For example, the layer of poly(methylsilyne) or poly(silyne-co-hydridocarbyne) may be heated at a range of temperatures, such as between 1500 and 1700 degrees Celcius. In this embodiment, graphene layer 285 may be constrained by first silicon carbide layer 280 and second silicon carbide layer 290.

In an alternative embodiment, a diamond layer may be formed on top of graphene layer 285. In that embodiment, the diamond layer may be formed by coating graphene layer 285 with a layer of poly(hydridocarbyne) as described in the method of FIG. 3. Once the layer of poly(hydridocarbyne) is coated on top of graphene layer 285, the layer of poly (hydridocarbyne) may be thermalized to form a diamond layer. In this alternative embodiment, graphene layer 285 may be physically and phonon constrained by first silicon carbide layer 280 and the diamond layer.

At step 440, a mask may be applied to second silicon carbide layer 290 in an embodiment. The mask may include a two-dimensional shape of a cathode, an anode, and one or more grids in certain embodiments. The mask may facilitate the reactive ion electron-beam etching of the geometries of two-dimensional cold cathode 220, two-dimensional anode 230, and two-dimensional grids 240. For example, as reactive-ions impact the top surface of second silicon carbide layer 290, the electrons may remove silicon carbide in unmasked areas and may not remove silicon carbide in masked areas.

At step 450, two-dimensional cold cathode 220, two-dimensional anode 230, and one or more two-dimensional grids 240 may be formed by reactive-ion electron-beam etching in an embodiment. For example, reactive ions may impact a top surface of second silicon carbide layer 290 and remove any material that is unmasked. Because the geometries of two-dimensional cold cathode 220, two-dimensional anode 230, and two-dimensional grids 240 are masked, the electrons may not remove material within the masked geometries of those components thereby forming two-dimensional cold cathode 220, two-dimensional anode 230, and two-dimensional grids 240. As a result of the steps described in steps 410 through 450, each of two-dimensional cold cathode 220, two-dimensional anode 230, and one or more two-dimensional grids 240 may include a portion of first silicon carbide layer 280, graphene layer 285, and second silicon carbide layer 290 (or a diamond layer in an alternative embodiment) such that graphene layer 285 may be positioned between first silicon carbide layer 280 and second silicon carbide layer 290 (or a diamond layer). Positioning graphene layer 285 between first silicon carbide layer 280 and second silicon carbide layer 290 (or a diamond layer) may prevent carbon atoms from escaping and eroding pointed tip 222 of two-dimensional cold cathode 220.

As an example embodiment of operation, first silicon carbide layer 280 may be formed on substrate 210. Graphene layer 285 may be induced from first silicon carbide layer 280 by heating first silicon carbide layer 280 and substrate 210. Second silicon carbide layer 290 may be formed on top of graphene layer 285. A mask may be applied to second silicon carbide layer 290 in the geometries of a cathode, an anode, and one or more grids. Two-dimensional cold cathode 220, two-dimensional anode 230, and two-dimensional grids 240 may be formed by electron-beam etching. Each of two-dimensional cold cathode 220, two-dimensional anode 230, and two-dimensional grids 240 may have a portion of first silicon carbide layer 280, graphene layer 285, and second silicon carbide layer 290.

The present disclosure may provide numerous advantages. For example, a two-dimensional graphene cold cathode may increase electron mobility while constraining carbon atoms thereby lowering operating voltage and decreasing tip erosion. As a result of the decreased tip erosion, the life of a cathode may be extended. As another example, phonon confinement of a two-dimensional graphene cold cathode may lower the operating voltage of a microelectronic. As yet another example, a two-dimensional graphene cold cathode may simplify microelectronic design by its intrinsic heat and radiation tolerance thereby reducing cooling and radiation shielding costs and weight.

Although the present disclosure has been described with several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims. For example, graphene layer 260 may be replaced with an electrically conductive boron-doped diamond layer. In that example, substrate 210 may be coated with three layers: a first poly(hydridocarbyne) layer, a layer of boron-doped poly(hydridocarbyne), and a second poly(hydridocarbyne) layer. Those layers may then be thermalized at temperatures between 150 and 800 degrees Celcius. The first and second poly(hydridocarbyne) layers may thermalize to form diamond, and the boron-doped poly(hydridocarbyne) layer may thermalize to form an electrically boron-doped diamond layer. Once thermalized, masking and reactive-ion electron-beam etching may be used to form two-dimensional cold cathode 220, two-dimensional anode 230, and one or more two-dimensional grids 240. In this example, each of two-dimensional code cathode 220, two-dimensional anode 230, and two-dimensional grids 240 may have a first layer of diamond, a layer of boron-doped diamond, and a second layer of diamond such that the layer of boron-doped diamond is positioned between the first layer of diamond and the second layer of diamond. As a result, the layer of boron-doped diamond may be phonon-constrained by the first and second layers of diamond.

The invention claimed is:

1. A method, comprising:

forming a first diamond layer on a substrate;

inducing a layer of graphene from the first diamond layer by heating the substrate and the first diamond layer;

forming a second diamond layer on top of the layer of graphene;

applying a mask to the second diamond layer, wherein the mask comprises a shape of a cathode, an anode, and one or more grids; and forming a two-dimensional cold cathode, a two-dimensional anode, and one or more two-dimensional grids by reactive-ion electron-beam etching, wherein each of the two-dimensional cold cathode, the two-dimensional anode, and the one or more two-dimensional grids comprises a portion of the first diamond layer, the graphene layer, and the second diamond layer such that the graphene layer is positioned between the first diamond layer and the second diamond layer.

2. The method of claim 1, wherein forming the first diamond layer on a substrate comprises coating the substrate with a poly(hydridocarbyne) layer and heating the substrate and the poly(hydridocarbyne) layer in an inert atmosphere.

3. The method of claim 2, wherein the substrate and the poly(hydridocarbyne) layer are heated at a temperature between 150 and 800 degrees Celsius.

4. The method of claim 2, wherein coating the substrate comprises spin-coating the substrate.

5. The method of claim 1, wherein the substrate and the first diamond layer are heated at a temperature between 400 degrees Celsius and 500 degrees Celsius.

6. The method of claim 1, wherein the substrate and the first diamond layer are heated at a temperature between 900 degrees Celsius and 1900 degrees Celsius.

7. The method of claim 1, wherein each edge of the two-dimensional anode comprises a round edge.

8. The method of claim 1, wherein the two-dimensional cold cathode comprises a pointed tip and a plurality of round edges.

9. A method, comprising:

forming a first silicon carbide layer on a substrate;

inducing a layer of graphene from the first silicon carbide layer by heating the substrate and the first silicon carbide layer;

forming a second silicon carbide layer on top of the layer of graphene;

applying a mask to the second silicon carbide layer, wherein the mask comprises a shape of a cathode, an anode, and one or more grids; and forming a two-dimensional cold cathode, a two-dimensional anode, and one or more two-dimensional grids by reactive-ion electron-beam etching, wherein each of the two-dimensional cold cathode, the two-dimensional anode, and the one or more two-dimensional grids comprises a portion of the first silicon carbide layer, the graphene layer, and the second silicon carbide layer such that the graphene layer is positioned between the first silicon carbide layer and the second silicon carbide layer.

10. The method of claim 9, wherein forming the first silicon carbide layer comprises coating the substrate with poly(methylsilyne) or poly(silyne-co-hydridocarbyne).

11. The method of claim 10, wherein coating the substrate comprises spin-coating the substrate.

12. The method of claim 9, wherein inducing the layer of graphene from the first silicon carbide layer comprises heating the substrate and the first silicon carbide layer at a temperature between 1500 degrees Celsius and 1700 degrees Celsius.

13. The method of claim 9, wherein each edge of the two-dimensional anode comprises a round edge.

14. The method of claim 9, wherein the two-dimensional cold cathode comprises a pointed tip and a plurality of round edges.

15. The method of claim 9, wherein forming the second silicon carbide layer comprises:

coating the layer of graphene with one of poly(methylsilyne) or poly(hydridocarbyne); and thermalizing the poly(methylsilyne) or poly(hydridocarbyne).

* * * * *